US005127199A

United States Patent [19]

Blankers et al.

[11] Patent Number: 5,127,199

[45] Date of Patent: Jul. 7, 1992

[54] ABRASIVE WATER JET CATCH TANK MEDIA TRANSPORTING MEANS

[75] Inventors: Joel D. Blankers, Kentwood, Mich.; Archie Tan, Roswell, Ga.

[73] Assignee: Progressive Blasting Systems, Inc., Grand Rapids, Mich.

[21] Appl. No.: 639,248

[22] Filed: Jan. 8, 1991

[51] Int. Cl.[5] ..... B24C 9/00

[52] U.S. Cl. ..... 51/425; 51/321; 51/424; 83/177; 210/167

[58] Field of Search ..... 51/317, 318, 319, 320, 51/321, 424, 425, 426, 429, 438, 439, 410, 427; 83/98, 99, 100, 53, 54, 177; 210/167, 171

[56] References Cited

U.S. PATENT DOCUMENTS

| | | | |
|---|---|---|---|
| 2,576,008 | 11/1951 | Gladfelter et al. | 51/427 X |
| 2,797,530 | 7/1957 | Garver | 51/427 X |
| 2,912,918 | 11/1959 | Mead | 51/425 X |
| 2,985,050 | 5/1961 | Schwacha | 83/53 |
| 3,149,445 | 9/1964 | Nolan | 51/319 |
| 3,237,351 | 3/1966 | Millhiser . | |
| 3,430,767 | 3/1969 | Lawalin et al. | 210/167 X |
| 3,447,272 | 6/1969 | Eppler | 51/319 |
| 3,553,895 | 11/1967 | Power | 51/321 X |
| 3,610,417 | 10/1971 | DeLoach | 210/167 |
| 3,651,607 | 3/1972 | Lee . | |
| 3,672,292 | 6/1972 | Arnold | 51/424 X |
| 3,730,040 | 5/1973 | Chadwick et al. | 83/177 |
| 3,863.392 | 2/1975 | Haker . | |
| 4,137,804 | 2/1979 | Gerber et al. | 83/177 |
| 4,248,110 | 2/1981 | Spivy . | |
| 4,250,024 | 2/1981 | Soares et al. | 51/425 X |
| 4,325,292 | 4/1982 | McNinney, Jr. et al. . | |
| 4,656,791 | 4/1987 | Herrington et al. | 51/321 X |
| 4,698,939 | 10/1987 | Hashish . | |
| 4,780,993 | 11/1988 | DeSpain et al. | 51/317 |
| 4,784,169 | 11/1988 | Striedieck | 210/167 X |
| 4,811.526 | 3/1989 | Roestenberg . | |
| 4,864,780 | 9/1989 | Ehlbeck et al. . | |
| 4,866,889 | 9/1989 | Goldman . | |
| 4,872,293 | 10/1989 | Yasukawa . | |
| 4,872,975 | 10/1989 | Benson . | |
| 4,937,985 | 7/1990 | Boers et al. . | |

FOREIGN PATENT DOCUMENTS

| | | |
|---|---|---|
| 990508 | 11/1973 | Canada . |
| 1921228 | 11/1970 | Fed. Rep. of Germany . |
| 62-79965 | 4/1985 | Japan . |

*Primary Examiner*—Bruce M. Kisliuk
*Assistant Examiner*—John A. Marlott
*Attorney, Agent, or Firm*—Price, Heneveld, Cooper, Dewitt & Litton

[57] ABSTRACT

An abrasive water jet catch tank assembly is provided for facilitating recovery of spent abrasives and kerf material from operation of an abrasive water jet. The catch tank assembly includes a catch tank having sides and a bottom for containing a fluid, and includes a recirculating system for recirculating fluid in the catch tank. The catch tank also includes connections for a filtration system for removing spent abrasive and kerf material from the fluid. The catch tank includes removable wear plates which dissipate residual energy from the abrasive water jet by sacrificially wearing thereby reducing damage to the tank. The wear plates are spaced above the bottom of the tank and divide the tank into an upper compartment which receives the abrasive water jet and a lower compartment which is continuously flushed to remove spent abrasives and kerf material from the tank. The recirculating system is designed to prevent a build up of spent abrasives, kerf material, or other waste in the catch tank, and includes a general flow of water from the upper area to the lower area and also a brisk dispersed flow of water across the lower area. Fluid is withdrawn from the lower compartment into drain pipes which lead to the filtration system. In the preferred embodiment, the tank is portable and includes fork truck lift channels and quick disconnects which facilitate moving. The tank also includes leveling feet and vibration isolation foot pads for reducing transmission of vibration to the machine which generates the abrasive water jet.

18 Claims, 4 Drawing Sheets

ABRASIVE WATER JET CATCH TANK MEDIA TRANSPORTING MEANS

BACKGROUND OF THE INVENTION

This invention relates to a catch tank assembly for use with abrasive high energy streams and particularly to a catch tank assembly and media transport means to facilitate recovery of spent abrasives and kerf material from operation of an abrasive water jet.

Abrasive water jet streams are useful for cutting parts where more traditional cutting methods are not effective or efficient. Historically, spent abrasives, kerf material, and other offal from operation of an abrasive water jet have been collected in a pit which is dug in the floor. The abrasive water jet is aimed downwardly toward the pit, and waste material is collected in the pit with the pit being cleaned a needed when it gets full. However, these pits are often unsatisfactory since they fill quickly and require frequent cleaning This in turn results in production downtime as well as wasted man power, time and effort. Further, pit cleaning is a less than desirable job.

In the aerospace industry, these waste and offal pits are even less desirable since the kerf materials need to be recovered for proper disposal. This need to recover the kerf is most typically due to the fact that the kerf materials are proprietary materials such as high alloy materials, titanium alloys, and proprietary composites. Above ground tanks have not proven to be satisfactory due to the same aforementioned problems given for pits (i.e frequent cleaning, maintenance problems) and for the additional reason that the residual energy of the abrasive water jet wears holes in the above ground tanks.

SUMMARY OF THE INVENTION

The present invention is directed to an abrasive water jet catch tank assembly which facilitates recovery of spent abrasives and kerf material from operation of an abrasive water jet. The catch tank assembly includes a catch tank having sides and a bottom for containing fluids, and includes a means for recirculating the fluid in the catch tank. The assembly further includes means for connecting to a filtering system to filter spent abrasives and kerf material from the fluid. The catch tank also includes means for dissipating residual energy from the abrasive water jet to prevent damage to the catch tank. In the preferred embodiment, the catch tank is portable to facilitate cleaning.

BRIEF DESCRIPTION OF THE DRAWINGS

This invention and its function and operation will be further explained by the following description with reference to the drawings in which.

DETAILED DESCRIPTION OF THE PREFERRED EMBODIMENT

Figure 1:
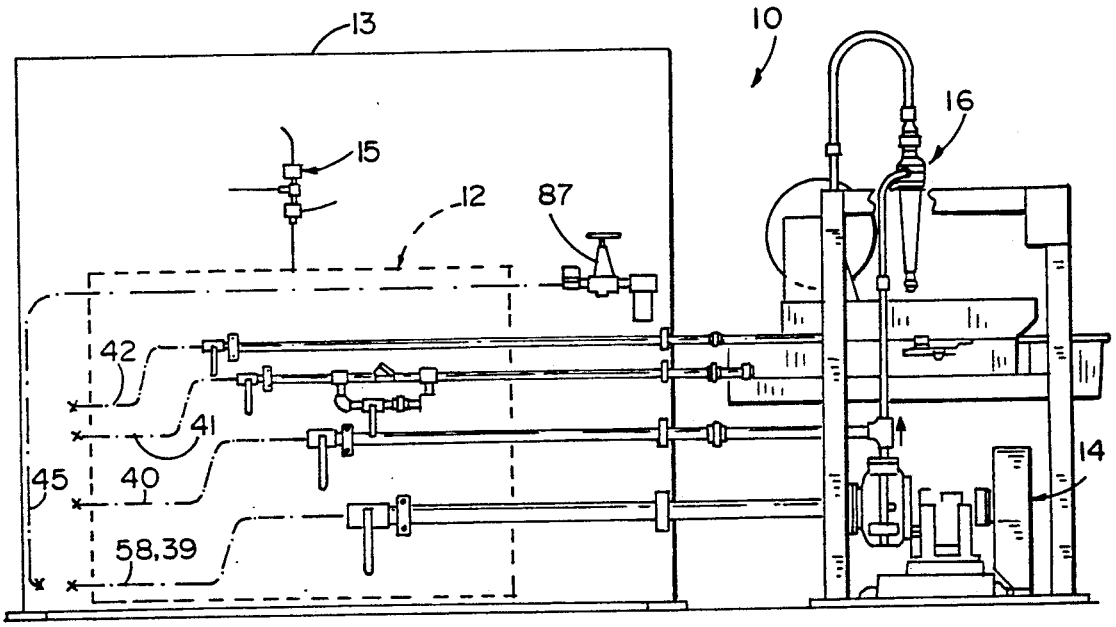
FIG. 1 is a front elevational view of an abrasive water jet system incorporating the catch tank assembly of this invention including an enclosure in which the abrasive water jet and the catch tank assembly are located, the view also showing the recirculating system, and the filtration system.
Figure 2:
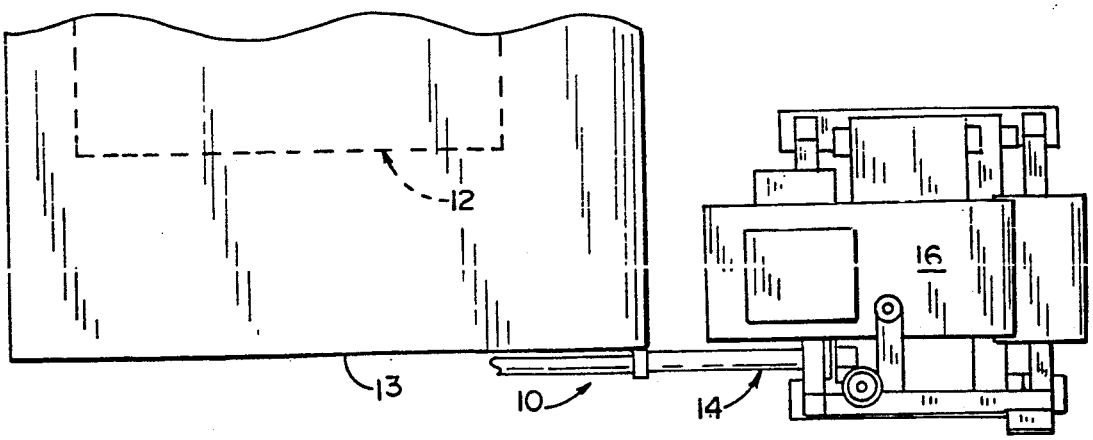
FIG. 2 is a top plan view of the apparatus and equipment of FIG. 1.
Figure 3:
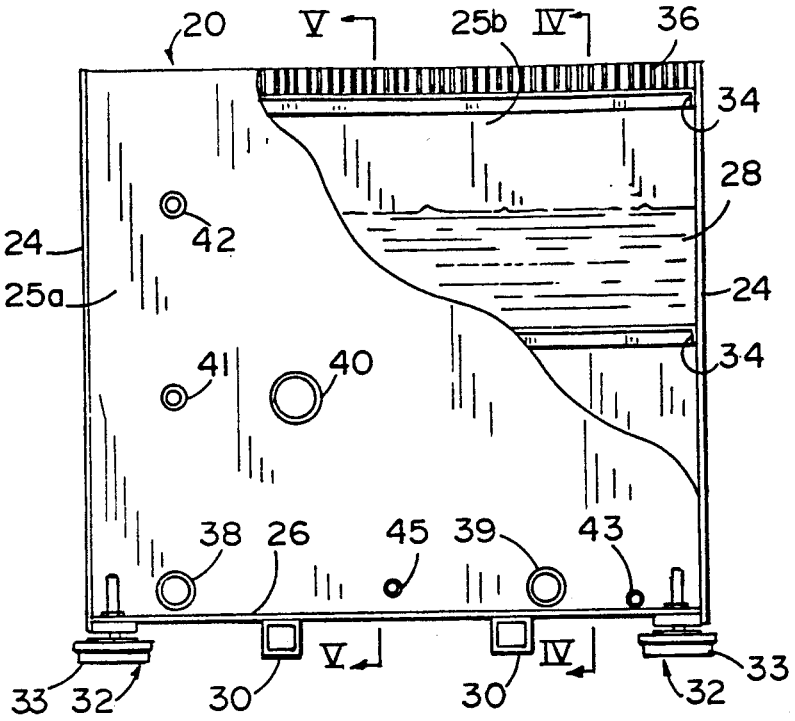
FIG. 3 is an end view of the catch tank.
Figure 4:
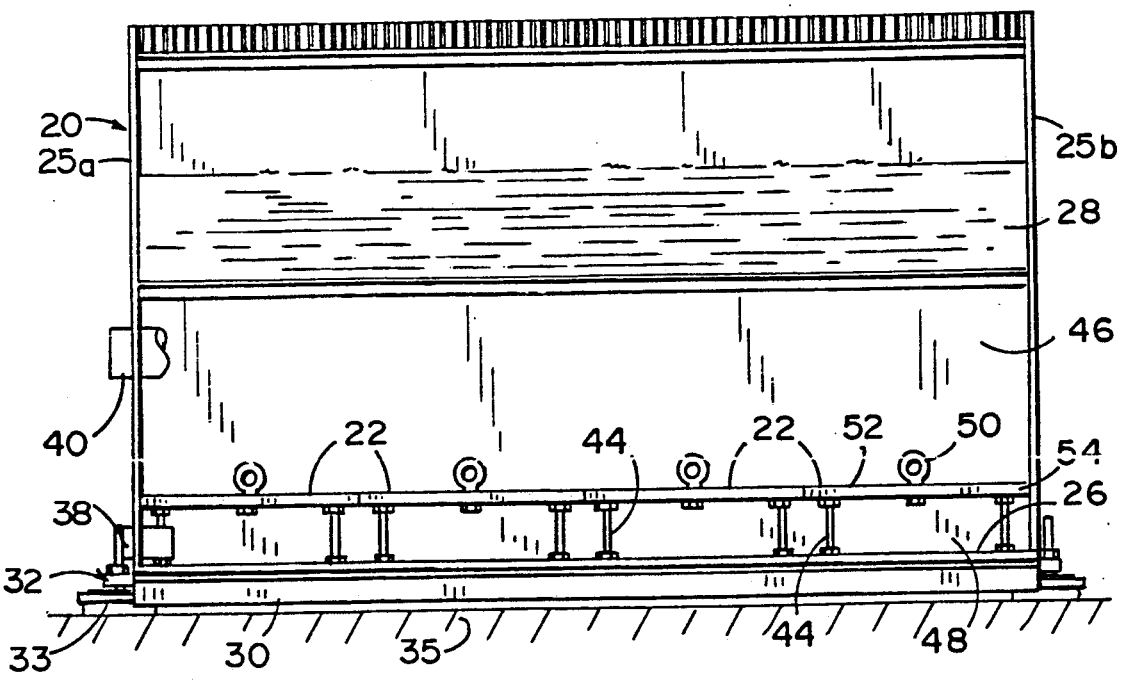
FIG. 4 is a cross-section taken through lines IV—IV in FIG. 3.

Referring initially to FIGS. 1 and 2, reference numeral 10 generally designates an abrasive water jet catch tank and recovery system which embodies the present invention. System 10 includes a catch tank assembly 12 which is housed in an enclosure 13 and is located adjacent the abrasive water jet head or machine 15. Catch tank assembly 12 is operably connected to a recirculation system and a filtration system 16 which cooperate with catch tank assembly 12 to recover spent abrasives and kerf material for proper disposal System 10 provides continuous filtration with a flow of water within tank assembly 12 designed to prevent buildups of spent abrasives and kerf materials so that frequent manual cleanings of the tank are not required. Catch tank assembly 12 is further designed with removable wear plates 22 which are mounted within the catch tank to sacrificially wear and dissipate the residual energy in the abrasive water jet stream as it traverses through the object being cut and downwardly into the tank. Catch tank assembly 12 is further plumbed with quick disconnects and adjustable foot pads to make it portable and to facilitate maintenance.

Catch tank 20 (FIGS. 3–7) includes sides 24, ends **5*a*, 25*b* and bottom 26 which form a container for fluid 28. Fluid 28 is primarily a mixture of water, spent abrasives and kerf material Attached to bottom 26 are fork lift channels 30 which permit catch tank 20 to be picked up and moved by a fork truck, thus making tank 20 portable to increase ease of maintenance. In the preferred embodiment, catch tank 20 is about 4 feet high by 4 feet wide and 6 feet long. Foot pads 32 adjustably support catch tank 20 and permit the tank to be leveled in a free standing position. Foot pads 32 include vibration isolation pads 33 to prevent transmittal of vibrations from catch tank 20 through supporting floor 35 to the abrasive water jet machine 15**.

On the inside of catch tank 20 are mounted 'L' brackets 34 which support grating 36. Grating 36 prevents large objects from accidentally falling into catch tank 20 and is galvanized to increase its life and reduce corrosion. 'L' brackets 34 also increase the rigidity of sides 24 and ends **25*a*, 25*b*. On one end 25*a* of catch tank 20 are two recirculation outlet connections 38, 39 and also recirculation input connections 40, 41 and 42 as will be discussed later, as well as manual drain 43 and water makeup connection 45**.

Wear plates 22 (FIG. 4 and 5) are removably mounted within catch tank 20 a distance above bottom 26 and divide catch tank 22 into an upper area or compartment 46 and a lower area or compartment 48. Wear plates 22 are supported in their spaced position by support members 44 which are bolts or the like fastened to wear plates 22 and downwardly extending therefrom. The supports 44 extend downwardly and rest on bottom 26 creating about an 5" depth in lower compartment 48. The preferred embodiment includes 3 or 4 supports 44 per plate to provide adequate and stable support. Wear plates 22 are designed to dissipate the residual energy in the abrasive water jet stream after the jet stream has cut through a part and as it traverses into fluid 28 in catch tank 20. Wear plates 22 sacrificially wear to protect tank 20 and plumbing from the abrasiveness of the high energy cutting stream. In the preferred embodiment, wear plates 22 are made of removable one inch thick steel plates equipped with eye bolts 50 to facilitate removal and replacement, and also to provide access to plumbing for servicing and periodic cleaning. Wear plates 22 include multiple vertical openings or holes 52 which are about ¼" in diameter and which facilitate movement of fluid abrasives, and kerf from upper compartment 46 to lower compartment 48. Wear plates 22 located near end 25*b* also include openings 54 which increase the volume of flow at end 25*b*, end 25*b* being opposite end 25*a* and recirculation outlet connections 38 and 39. This arrangement defines the flow pattern creating a wash effect across plates 22, thus reduces the tendency of buildups to occur in upper compartment 46.

Figure 5:
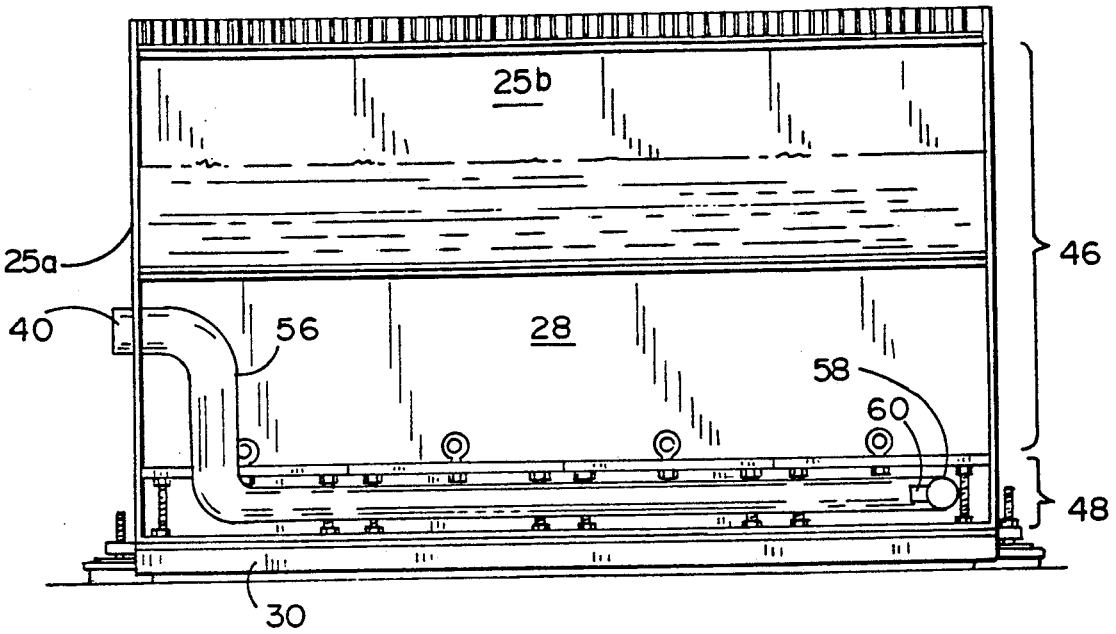
FIG. 5 is a cross-section taken through lines V—V in FIG. 3.
Figure 6:
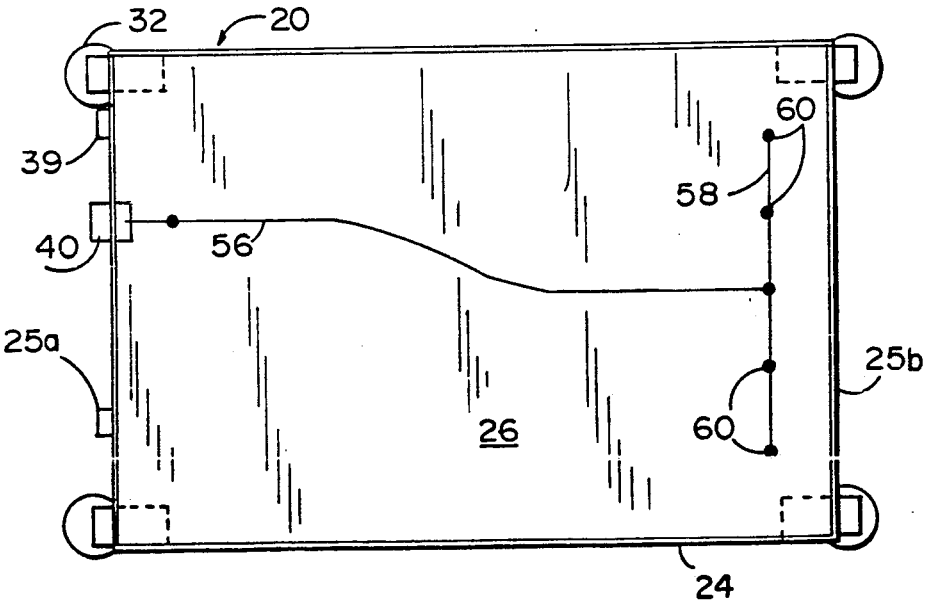
FIG. 6 is a top view schematic illustrating the layout of the inlet piping.
Figure 7:
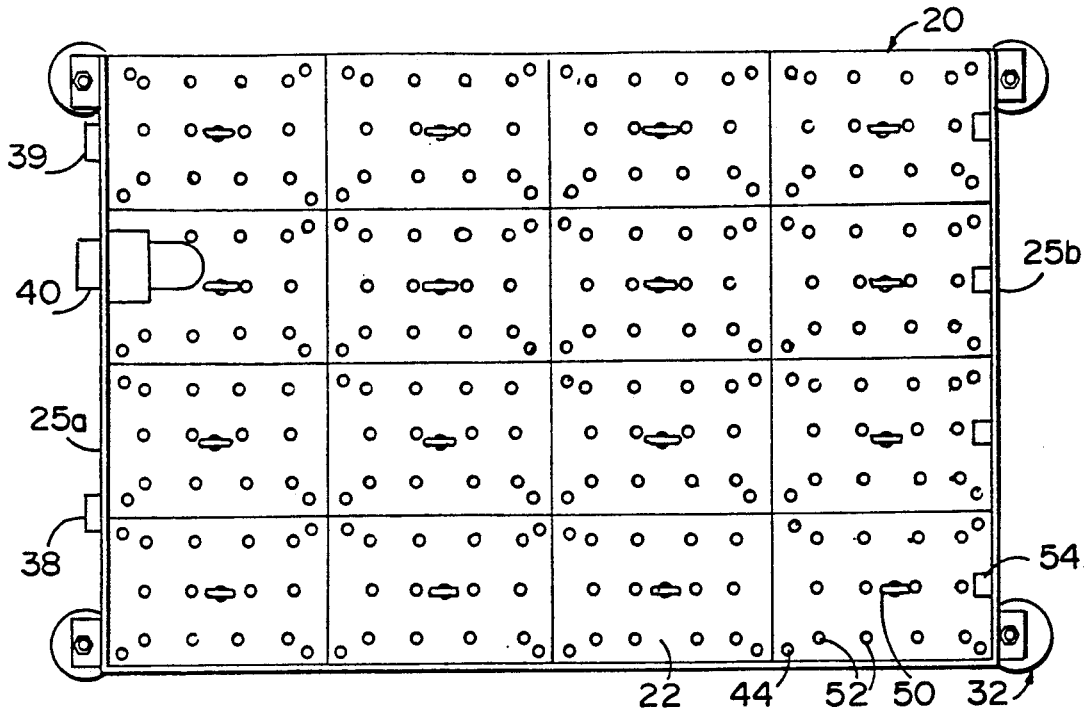
FIG. 7 view of the catch tank assembly.
Figure 8:
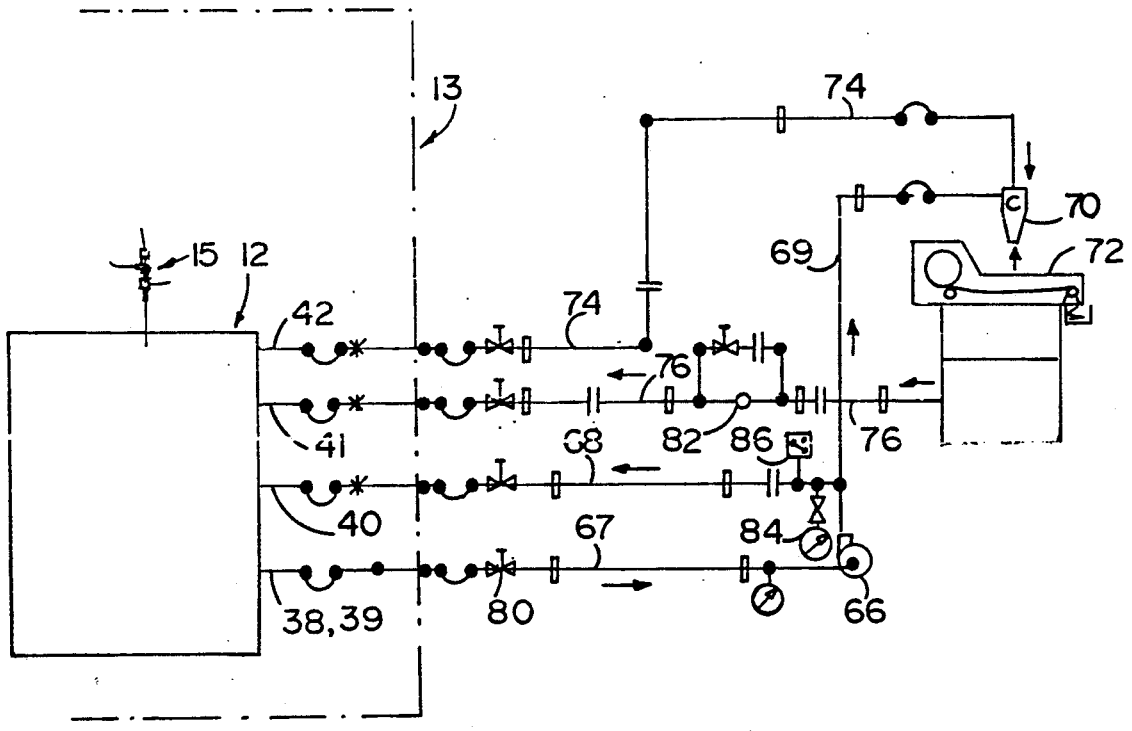
FIG. 8 is a piping diagram.

End 25*a* includes multiple plumbing connections to facilitate connecting catch tank 20 to recirculation system 14 and filtration system 16. In the preferred embodiment, all of the connections are at one end to facilitate installation, but it is contemplated that other arrangements can be used. Input connection 40 is the primary recirculation fluid inlet and is located at end 25*a* along with drain connections 38, 39 and input connections 41 and 42. Input connection 40 is plumbed to handle fluid volumes of about 150 gpm, but can vary in size as required. In the preferred embodiment, input connection 40 is located above the other connections to facilitate installation. Piping 56 extends from input connection 40 into catch tank 20 through end 25*a*, downwardly into lower compartment 48 and then toward end 25*b* (FIGS. 5 and 6). Piping 56 connects to a manifold 58 which directs the fluid in a dispersed manner through nozzles 60 from end 25*b* toward end 25*a* and drains 38, 39. By this method, a spread directional flow of water is created across lower compartment 48 from end 25*b* toward end 25*a*. In the preferred embodiment water is dispersed through input connection 40 and through manifold 58 at a rate of 150 gpm which causes a substantial directional flow across lower compartment 48 thus reducing the buildups or deposits of spent granular abrasives and kerf material Catch tank 20 also includes input connections 41 and 42. In the preferred embodiment, water is added at about 5 gpm through input connection 41 and at about 45 gpm through input connection 42 as discussed below. Since water is withdrawn from lower compartment 48 at about 200 gpm and added to lower compartment 48 at about 150 gpm, the addition of 50 gpm through input connections 41 and 42 causes a general current to flow from upper compartment 46 downwardly to lower compartment 48 through openings 52 and 54. The flow through openings 54 tends to cause a generally lateral and downward flow in upper compartment 46 toward end 25*b* which assists in the preventing buildups of spent abrasives and kerf material. Connectors 38–42 may be provided with quick disconnect fittings to facilitate rapid disconnection and removal of catch tank 20. This facilitates cleaning and repair as is sometimes required.

Recirculation system 14 is designed to both recirculate fluid in catch tank 20 and also pump fluid to filtration system 16. Recirculation system 14 is comprised of a high volume pump 66 which draws about 200 gpm of fluid through drain connections 38, 39 and pipe 67. Pump 66 outputs fluid into a return line 68 at about 150 gpm and pumps 50 gpm through filtration input pipe 69 to a hydrocyclone 70 in filtration system 16. Hydrocyclone 70 separates about 45 gpm which it returns through piping 74 to tank 20 and input connection 42, and concentrates the spent granular abrasives and kerf material into a 5 gpm stream of fluid which is filtered by band filter 72. The 5 gpm is returned from the band filter 72 through return lines 76 to input connection 41. Both input connections 41 and 42 are plumbed to return fluid to upper compartment 46.

An automatic water makeup system (FIG. 1) is attached to tank connection 45 on catch tank 20 to make up water which is lost through the filtration process at band filter 72 and also through spilled, splashed and evaporated water. A drain 43 also facilitates emptying of fluid within tank 20. Further, miscellaneous controls facilitate operation of recirculation system 14 such as shutoff valves 80, check valve 82, pressure shutoff valve 84, and switch 86.

OPERATION

Having described the apparatus for receiving an abrasive water jet and dissipating the residual energy in the stream therefrom and also for recovering spent abrasives and kerf material for proper disposal, the operation of this invention should become evident. Briefly, the operation begins with a part placed over the catch tank assembly 12 in position to be cut by machine 15 which creates an abrasive water jet stream. Recirculation system 14 and filtration system 16 are operably connected to catch tank assembly 12 and turned on. As machine 15 generates the abrasive water jet, the residual energy of the abrasive water jet carries it into fluid 28 in catch tank 20 and downwardly into the tank. A portion of the abrasive water jet stream reaches wear plates 22 before the residual energy in the abrasive water jet stream has fully dissipated, and wear plates 22 sacrificially protect catch tank 20 from undesirable wear. The abrasive water jet stream carries spent abrasives and kerf material into the fluid contained within catch tank 20. Recirculation system 14 creates about a 50 gpm flow from upper compartment 46 to lower compartment 48 through openings 52 and openings 54 thus creating a downward and lateral flow or current which carries the spent granular abrasives and kerf material toward lower compartment 48. The action of the abrasive water jet stream and input connections 40–42 further act to create a swirling action in upper compartment 46 thereby increasing the tendency of the spent abrasives or kerf material to stay in suspension in fluid 28 and reducing the tendency to form buildups or deposits within catch tank 20.

As the spent abrasives and kerf material are carried into lower compartment 48, they are flushed laterally across lower compartment 48. Specifically, about 150 gpm of fluid enters input connections 40 and flows through pipe 56 and out of nozzles 60 creating a directional flow across lower compartment 48 which is collected at the other end in two drain connections 38 at the rate of 200 gpm. The difference of 50 gpm between input 40 and output 38, 39 is made up by fluid flowing from upper compartment 46 through openings 52, 54 to lower compartment 48. Fluid passes through drain connections 38 through piping 67 to recirculation pump 66. Recirculation pump 66 then pumps about 150 gpm back to tank 20 and also pumps about 50 gpm to hydrocyclone 70 which separates and concentrates the granular abrasives and kerf material The concentrated stream (about 5 gpm) is filtered by band filter 72 and, along with the 45 gpm unfiltered offal stream from the hydrocyclone 70, is dumped back into tank 20 at input connections 41 and 42. Lost fluid is made up by an automatic water make up system input through connection 45. When necessary for maintenance, tank 20 is fully drained through drain 43.

It should be evident from the above description that we have provided a catch tank and recovery system for catching abrasive water jet stream and dissipating the residual energy in the stream, and for recovering spent abrasives and kerf material for proper disposal This is made possible by the unique catch tank assembly of this invention which includes wear plates to prevent undesirable wear in the catch tank.

Having described our invention, it should be understood that although that a preferred embodiment has been disclosed herein, other modifications and embodiments can be utilized without departing from the spirit of this invention. Therefore, this invention should not be limited to only the embodiment illustrated, which has been described by an example only.

The embodiments of the invention in which an exclusive property or privilege is claimed or defined as follows:

1. An abrasive water jet catch tank assembly for facilitating recovery of spent abrasives and kerf material from operation of an abrasive water jet, the catch tank assembly comprising:

a catch tank having sides and a bottom for containing fluid, and further including support members along the bottom of the catch tank;

means for sacrificially dissipating residual energy from the abrasive water jet to prevent damage to the catch tank including wear plates; the wear plates being supported by the support members a distance above the bottom of the catch tank and located in the catch tank so as to create an upper and lower area in the catch tank, the lower area being useful for removal of fluid mixed with spent abrasive and kerf material, the wear plate including openings which allow fluid along with spent abrasives and kerf material to pass through and around the wear plates between the upper and lower areas;

means for recirculating the fluid in the catch tank between the upper and lower areas; and plumbing means for connecting to a remote filtering system for filtering spent abrasives and kerf material from the fluid in the lower area of the catch tank including multiple plumbing connections attached to the sides of the catch tank, the means for recirculating causing the fluid to circulate and maintain the spent abrasives and kerf material in suspension in the fluid, whereby the fluid in the upper area experiences reduced agitation and tendency to splash, but buildup of deposits of spent abrasives and kerf material is minimized.

2. The apparatus defined in claim 1 wherein the means for recirculating causes the spent abrasives and kerf material to traverse toward the lower area and the means for recirculating also draws off fluid from the lower area for filtering.

3. The apparatus defined in claim 2 wherein the catch tank includes one or more drain outlets, and the means for recirculating creates directional flow across the lower area toward the outlets to prevent buildups of spent abrasive and kerf material in the bottom of the catch tank.

4. The apparatus defined in claim 3 wherein the means for recirculating draws fluid from one or more drain outlets locating in the lower area and pumps a first portion of the fluid back into the catch tank and pumps a second portion of the fluid to the means for filtering.

5. The apparatus defined in claim 3 wherein the means for recirculating includes multiple nozzles which cause the directional flow across the lower area to be widespread thus reducing the tendency of buildups of spent abrasives and kerf material to occur along the edges of the catch tank.

6. The apparatus defined in claim 5 including an inlet, the inlet and outlets are located at one end of the catch tank, and plumbing connects the inlet with the multiple nozzles which are located at the opposite end of the catch tank.

7. The apparatus defined in claim 5 wherein there are additional openings in the wear plates located opposite the drain outlets to balance the current flowing from the upper area to the lower area.

8. The apparatus as defined in claim 1 which cooperates with a machine for producing an abrasive water jet, the apparatus including means for isolating the catch tank from the machine to prevent transmission of vibrations from the catch tank to the machine.

9. The apparatus defined in claim 8 wherein the means for isolating includes vibration isolation foot pads.

10. The apparatus as defined in claim 1 wherein the catch tank is portable and includes structural means for facilitating the moving of said catch tank by a fork truck.

11. An abrasive water jet catch tank assembly for facilitating recovery of spent abrasives and kerf material from operation of an abrasive water jet, the catch tank assembly comprising:

a catch tank having sides and a bottom for containing fluid;

removable wear plates spaced a distance above the bottom of the catch tank, the wear plates substantially dividing the catch tank into upper and lower compartments, the wear plates including openings to permit fluid carrying spent abrasives and kerf material to flow from the upper compartment to the lower compartment;

support members which hold the wear plates above the bottom of the catch tank;

one or more drain connections for withdrawing fluid from the lower compartment of the catch tank;

a first input connection for adding fluid back to the lower compartment of the catch tank, the input connection operably connected to nozzles which deposit the fluid back into the lower compartment and create a directional flow of fluid toward the drain connections to reduce formation of buildups of spent abrasives and kerf material in the lower compartments; and a second input connection for adding fluid back into the upper compartment of the catch tank to create a current from the upper compartment to the lower compartment.

12. The apparatus defined in claim 11 wherein the drain connection is capable of a flow of about 200 gpm, the first input connection is capable of a flow of about 150 gpm, and the second input connection is capable of a flow of about 50 gpm.

13. The apparatus defined in claim 11 wherein the catch tank is portable and includes structural means for facilitating the moving of said catch tank by a fork truck.

14. The apparatus defined in claim 11 wherein the drain connections and the first and second input connections include quick disconnect fittings.

15. A method for dissipating residual energy from operation of an abrasive water jet and for filtering spent abrasives and kerf material from a fluid mixed therewith as a result of the operation of the abrasive water jet, the method comprising:

providing a catch tank filled with fluid which includes wear plates therein;

dissipating residual energy from operation of an abrasive water jet by placing the tank under the abrasive water jet so that the abrasive water jet travels into the catch tank and against the wear plates thereby sacrificially wearing the wear plates and preserving the catch tank;

recirculating fluid in the catch tank to keep spent abrasives and kerf material substantially in suspension in the fluid; and filtering the spent abrasive and kerf material from the fluid.

16. The method defined in claim 15 the catch tank includes an upper and lower compartment which are in communication, and wherein the step of recirculating fluid includes flushing the lower compartment with a steady stream of fluid and further includes creating a general current from the upper compartment to the lower compartment to carry spent abrasives and kerf material into the lower compartment.

17. The method defined in claim 16 wherein the step of recirculating fluid includes withdrawing fluid from the lower compartment and recirculating a first portion into the upper compartment and a second portion into the lower compartment.

18. The method defined in claim 15 wherein the catch tank is portable and includes structural means to facilitate the moving of the catch tank by a fork truck; and including a step of moving the catch tank to facilitate replacement of the wear plates and to facilitate repair of the catch tank.

* * * * *

UNITED STATES PATENT AND TRADEMARK OFFICE

CERTIFICATE OF CORRECTION

PATENT NO. : 5,127,199

DATED : July 7, 1992

INVENTOR(S) : Joel D. Blankers et al.

It is certified that error appears in the above-identified patent and that said Letters Patent is hereby corrected as shown below:

Column 1, line 19:
"a needed" should be --as needed--.

Column 1, line 21:
After "cleaning" insert --.--.

Column 2, line 5:
After "FIG. 7" insert --is a top--.

Column 2, line 17:
After "recirculation system" insert --14--.

Column 2, line 19:
After "disposal" insert --.--.

Column 2, line 32:
"ends 5a" should be --ends 25a--.

Column 2, line 35:
After "material" insert --.--.

Column 3, line 44:
After "material" insert --.--.

Column 4, line 11:
After "system" insert --87--.

Column 4, line 68:
After "material" insert --.--.

Column 5, line 12:
After "disposal" insert --.--.

UNITED STATES PATENT AND TRADEMARK OFFICE

CERTIFICATE OF CORRECTION

PATENT NO. : 5,127,199

DATED : July 7, 1992

INVENTOR(S) : Joel D. Blankers et al.

It is certified that error appears in the above-identified patent and that said Letters Patent is hereby corrected as shown below:

Column 8, line 3, claim 15:
After "claim 15" insert --wherein--.

Signed and Sealed this

Fifth Day of October, 1993

Bruce Lehman

*Attest:*

BRUCE LEHMAN

*Attesting Officer*

*Commissioner of Patents and Trademarks*